US006925674B2

(12) United States Patent
Prince et al.

(10) Patent No.: US 6,925,674 B2
(45) Date of Patent: Aug. 9, 2005

(54) EDGING ROLLER

(75) Inventors: Michael D. Prince, Chicago, IL (US); Michael H. Reedy, Chicago, IL (US); Sona N. Patadia, Hanover Park, IL (US); Matthew G. Goulet, Milwaukee, WI (US); Craig S. Serio, New Berlin, WI (US)

(73) Assignee: Newell Operating Company, Freeport, IL (US)

( * ) Notice: Subject to any disclaimer, the term of this patent is extended or adjusted under 35 U.S.C. 154(b) by 2 days.

(21) Appl. No.: 10/328,594

(22) Filed: Dec. 23, 2002

(65) Prior Publication Data

US 2003/0233721 A1 Dec. 25, 2003

Related U.S. Application Data

(60) Provisional application No. 60/342,293, filed on Dec. 21, 2001.

(51) Int. Cl.[7] ..... B05C 17/02; B05C 21/00

(52) U.S. Cl. ..... 15/230.11; 15/248.2; 15/246

(58) Field of Search ..... 15/230.11, 248.2

(56) References Cited

U.S. PATENT DOCUMENTS

| | | | | |
|---|---|---|---|---|
| 375,919 A | | 1/1888 | Boyle | |
| 756,695 A | | 4/1904 | Peterson | |
| 2,160,570 A | | 5/1939 | Welt | 101/376 |
| 2,763,022 A | | 9/1956 | Glacken | 15/248 |
| 2,799,886 A | | 7/1957 | Brunelli et al. | 15/248 |
| 2,907,061 A | | 10/1959 | Whalen | 15/114 |
| 3,052,910 A | | 9/1962 | Kushner | 15/531 |
| 3,175,241 A | * | 3/1965 | Singleton et al. | 15/248.2 |
| 3,204,276 A | | 9/1965 | Kennedy, Sr. | 15/230.11 |
| 3,213,477 A | | 10/1965 | Shafer | 15/248 |
| 3,274,637 A | | 9/1966 | Schulze | 15/522 |
| 3,369,269 A | | 2/1968 | Deck et al. | 15/230.11 |
| 3,623,180 A | | 11/1971 | Anderson | 15/230.11 |
| 3,685,084 A | | 8/1972 | Bennett | 15/230.11 |
| 3,832,749 A | | 9/1974 | Hawk | 15/230.11 |
| 4,063,325 A | | 12/1977 | Lizak | 55/230.11 |
| 4,091,493 A | | 5/1978 | Weiss | 15/248 A |
| 4,100,642 A | | 7/1978 | Gabor | 15/114 |
| 4,564,970 A | | 1/1986 | Latraverse | 15/230.11 |
| 5,400,459 A | | 3/1995 | Jarecke et al. | 15/230.11 |
| 5,444,891 A | | 8/1995 | Benson | 15/248.2 |
| 5,623,740 A | | 4/1997 | Burns et al. | 15/230.11 |
| 5,864,918 A | | 2/1999 | Kosick | 15/248.2 |
| 6,687,945 B2 | * | 2/2004 | Robinson | 15/230.11 |
| 2002/0194691 A1 | * | 12/2002 | Meyer | 15/230.11 |

* cited by examiner

*Primary Examiner*—John Kim
*Assistant Examiner*—Shay L Balsis
(74) *Attorney, Agent, or Firm*—Marshall, Gerstein & Borun LLP

(57) ABSTRACT

The present disclosure provides a paint applicator which may be used to apply paint to corners, to junctions between adjacent walls, along window trim, along floor moldings, or other surface adjacent to the surface being painted, without smearing paint on the adjacent surface. Moreover, the present disclosure provides a paint applicator having a trim system that prevents the painter's hands from becoming covered with paint upon actuation of trim system.

20 Claims, 19 Drawing Sheets

EDGING ROLLER

CROSS REFERENCE TO RELATED APPLICATION

This claims the benefit under 35 U.S.C. §119(e) of U.S. provisional patent application Ser. No. 60/342,293, filed Dec. 21, 2001, the disclosure of which, in its entirety, is incorporated herein by reference.

FIELD OF THE DISCLOSURE

The present disclosure relates to paint rollers. More specifically, the present disclosure relates to paint rollers having shields or guards for applying paint to surfaces which are adjacent to trim, window moldings, and the like.

BACKGROUND OF THE DISCLOSURE

Paint rollers are popular tools for applying paint to large surface areas. Paint rollers typically include a handle, a shaft extending from the handle, and a roller rotatably coupled to the shaft. Although well-suited for applying paint to large expansive areas, such conventional rollers are not well-suited for applying paint to corners, to junctions between adjacent walls, along window trim, or along floor moldings, without smearing paint on the adjacent surface.

In recognition of such shortcomings, paint rollers have been provided with guards or shields mounted to an axial end of the roller. Examples of such paint rollers include U.S. Pat. Nos. 2,763,022; 3,623,180; 3,685,084; and 3,213,477. Although representing an advance in the art, such rollers are tedious and time consuming to use because repeated loading of the paint roller requires repeated detachment and attachment of the shield to and from the roller.

To facilitate loading of paint, alternative paint rollers have been developed in which the guard or shield may be pivoted away from the roller. Examples of such paint rollers are disclosed in U.S. Pat. Nos. 3,204,276; 3,369,269; and 5,444,891. Although facilitating paint loading, such paint rollers have their associated drawbacks as well. For example, such shields or guards are typically supported by an arm which is difficult to grasp and manipulate positioning of the shield without the painter's hands becoming covered with paint. In addition, such rollers require that the roller and adjacent shield be pressed towards the surface being painted with a relatively large amount of force to apply paint as close as possible to the adjacent surface such as trim. As a result, the roller does not roll and frequently skids along the surface being painted. Moreover, such paint rollers are often fatiguing to use and aesthetically unattractive.

U.S. Pat. No. 5,623,740 discloses a paint roller in which the roller pivots away from the guard. In addition to having the aforementioned problems, the applicator having a roller that rotates away from the shield frequently results in paint splattering.

BRIEF DESCRIPTION OF THE DRAWINGS

Exemplary aspects and features of a paint applicator in accordance with the present disclosure are described and explained in greater detail below with the aid of the drawing figures in which.

DETAILED DESCRIPTION OF THE DISCLOSURE

Figure 1:
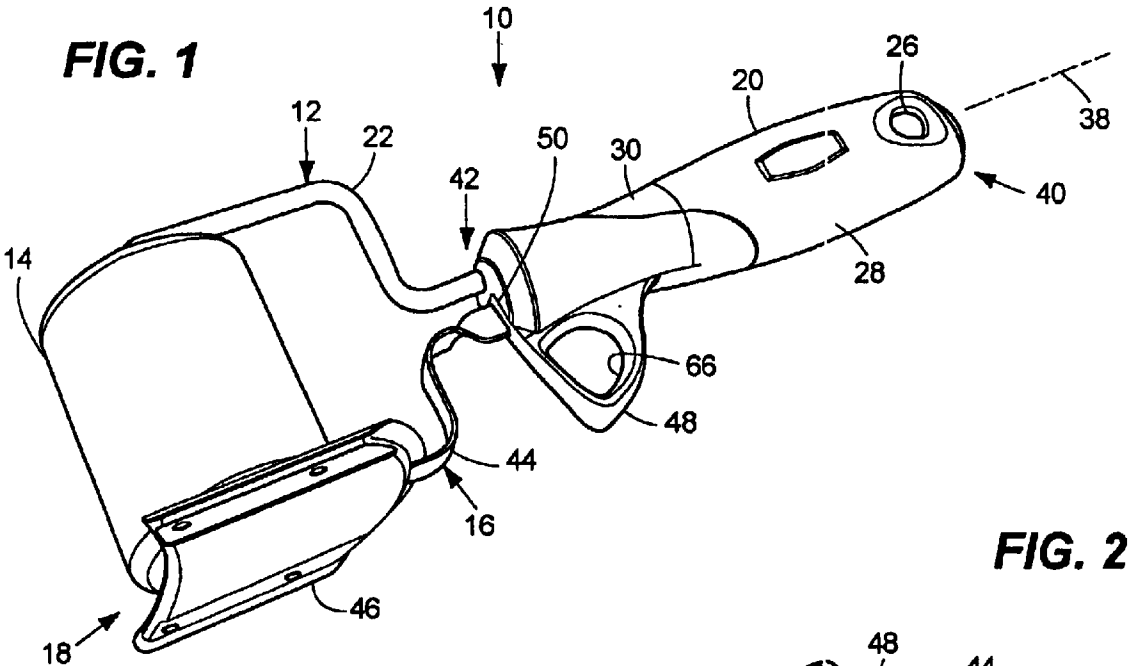
FIG. 1 is a perspective view of a paint applicator in accordance with the disclosure.
Figure 2:
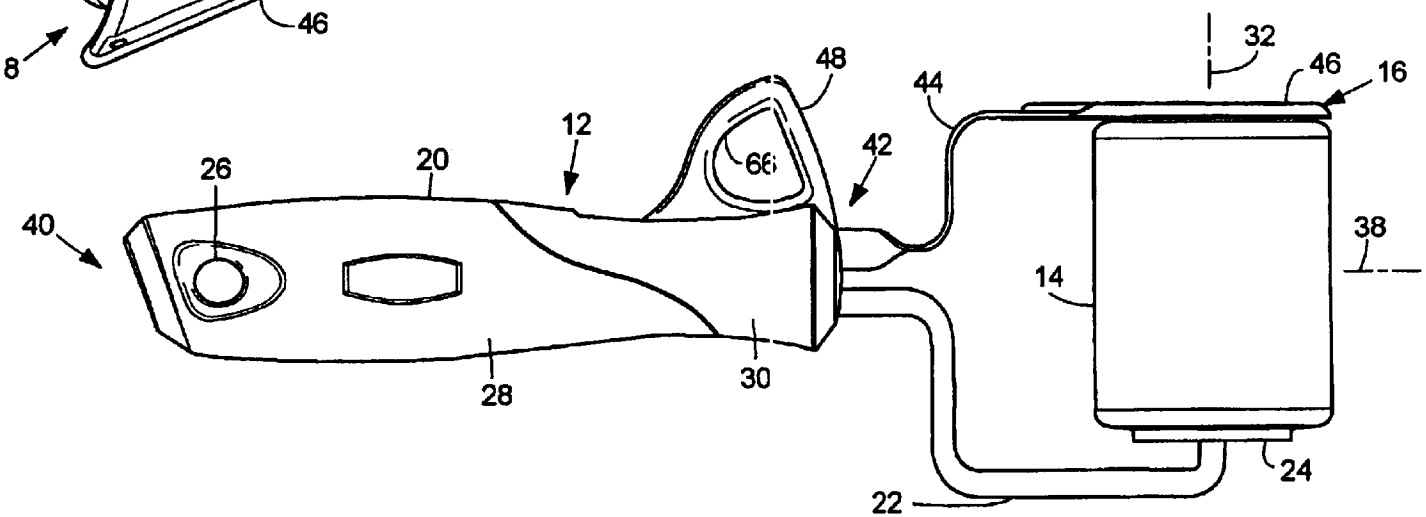
FIG. 2 is a top view of the paint applicator shown in FIG. 1.
Figure 3:
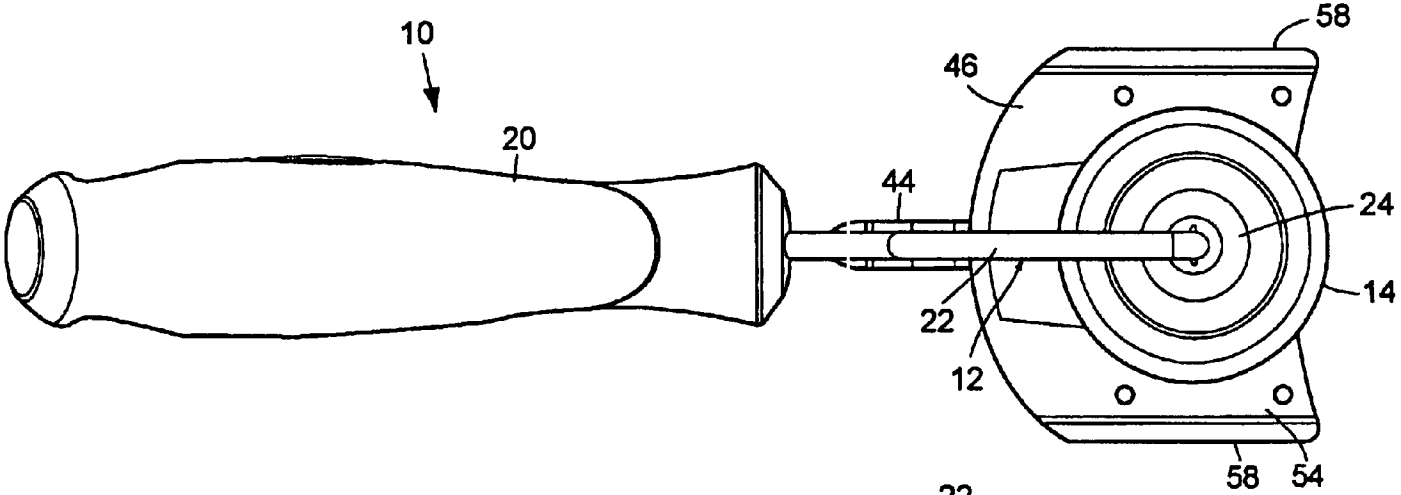
FIG. 3 is a right side view of the paint applicator shown in FIG. 1.
Figure 4:
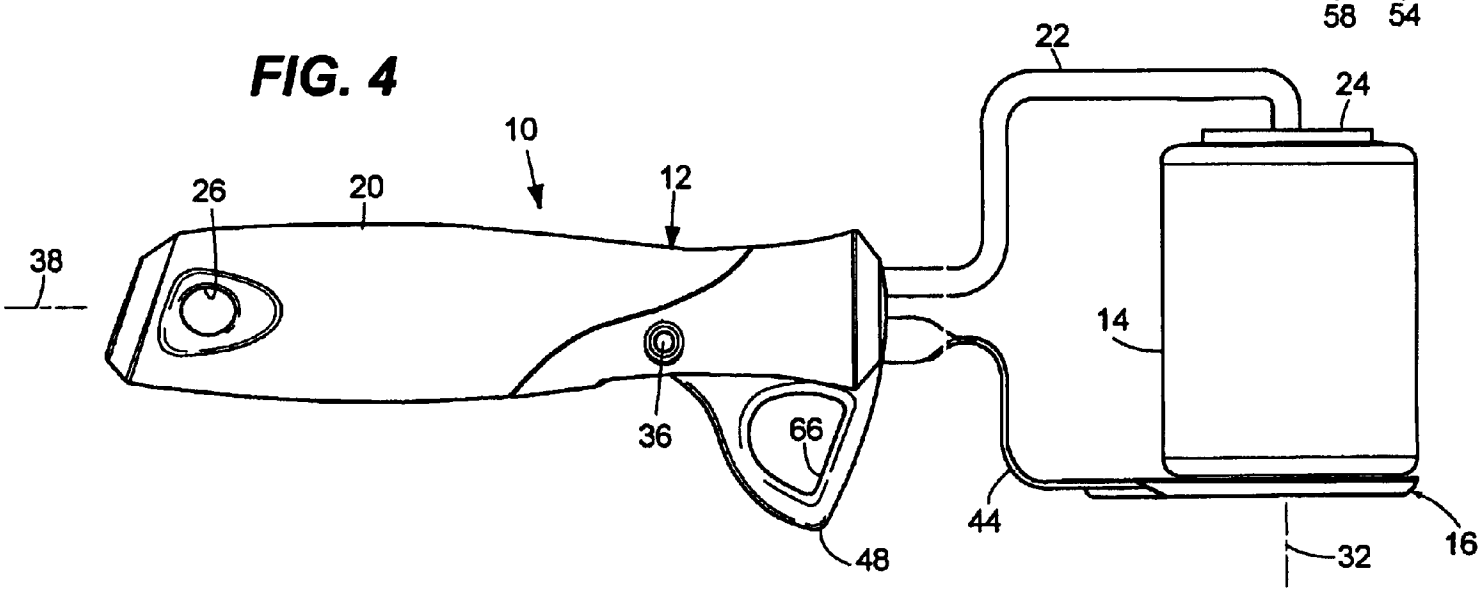
FIG. 4 is a bottom view of the paint applicator shown in FIG. 1.
Figure 5:
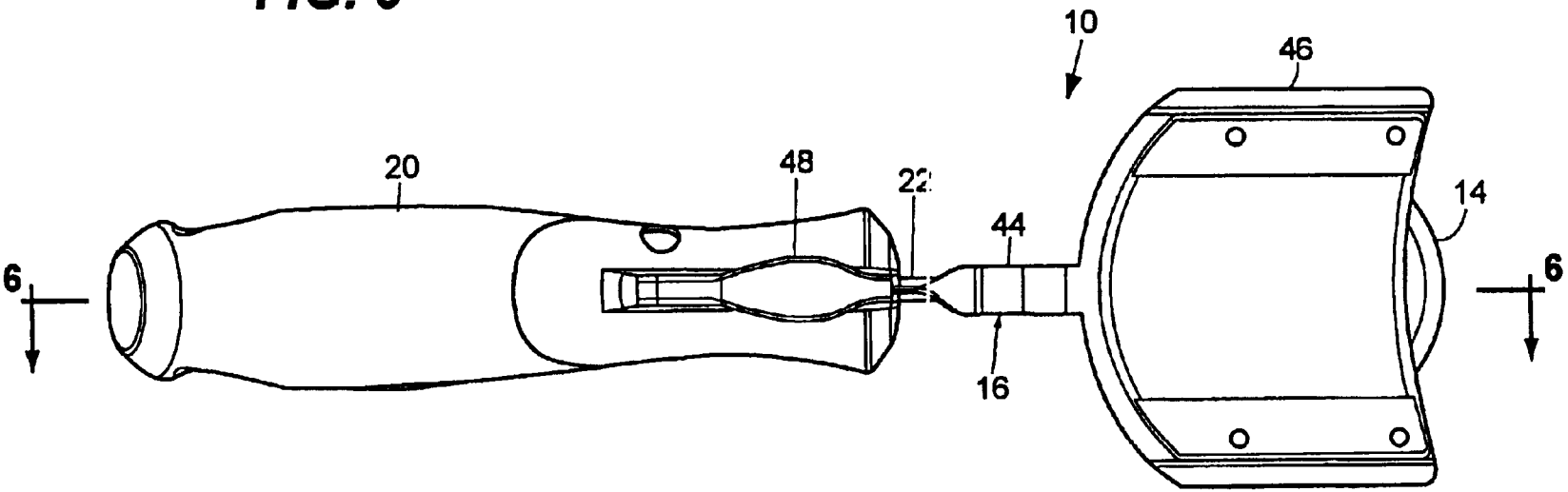
FIG. 5 is a left side view of the paint applicator shown in FIG. 1.
Figure 6:
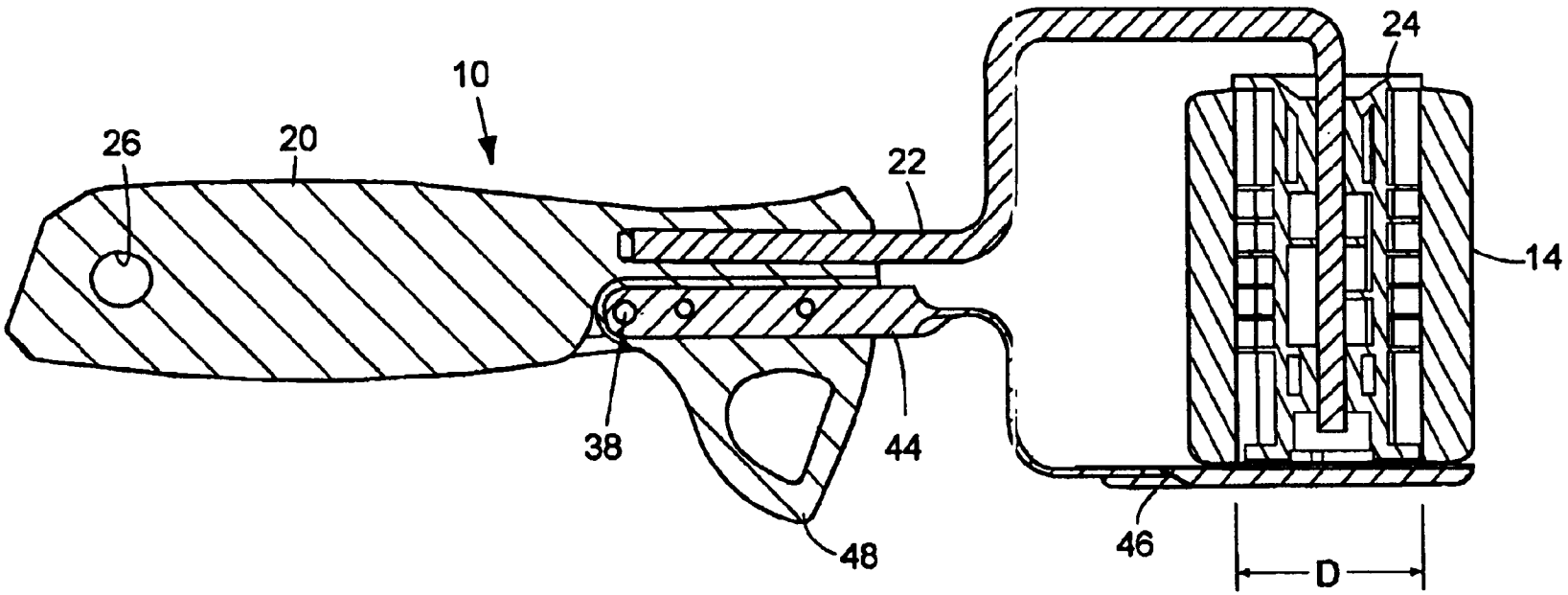
FIG. 6 is a cross sectional view along line 6—6 of the paint applicator shown in FIG. 5.

FIGS. 1–7 illustrate paint applicator 10 (also known as a paint roller tool). Paint applicator 10 generally includes roller support 12, roller 14, and trim system 16. Roller support 12 rotatably supports roller 14 and further supports trim system 16 for movement towards and away from an axial end 18 of roller 14. Roller support 12 generally includes handle 20, frame 22, and bearing member 24 (shown in FIG. 6).

Handle 20 provides a surface about which a painter may grasp applicator 10. Although handle 20 preferably includes hang hole 26 and an exterior layer 28 of a soft, elastomeric material such as Santroprene® thermoplastic elastomers (Advanced Elastomer Systems, Akron, Ohio) overlying a rigid core 30 of material such as plastic, metal, or wood, handle 20 may omit such features and be made from a variety of other materials. Further, although handle 20 is preferably substantially solid, handle 20 may alternatively include hollow portions to reduce its weight and manufacturing costs.

Frame 22 generally comprises a rod, shaft, or other rigid structure projecting from handle 20, and coupled to bearing member 24. Frame 22 is preferably configured such that roller 14 rotates about a roller axis 32 substantially perpendicular to a longitudinal axis 38 of handle 20. Although preferably formed from metal, frame 22 may alternatively be formed from plastic and may have other shapes or configurations.

Bearing member 24 (shown in FIG. 6) rotatably supports roller 14 along roller axis 32. In the exemplary embodiment, bearing member 24 comprises a conventionally known plastic cage rotatably supported about frame 22. Alternatively, bearing member 24 may comprise a conventionally known wire cage rotatably supported about frame 22. In yet additional alternative embodiments, bearing member 24 may comprise other conventionally known or future developed structures or mechanisms for rotatably supporting a generally cylindrical member about an axis. Examples of such structures include ball bearings and the like. Although bearing member 24 is preferably separable from roller 14, bearing member 24 may alternatively be permanently adhered or coupled to roller 14, and may be configured to be removed from frame 22 with roller 14.

Roller 14 generally comprises an elongate cylindrical member having an outer circumferential surface configured to be rolled along a surface and to apply (or remove) paint to the surface. This circumferential surface may be provided by various materials including fabric nap, mohair, natural or synthetic sponge, felt, and the like. The surface may be uniform or may be patterned. Although the surface is preferably liquid permeable so as to absorb, carry, and release liquid coatings, the exterior circumferential surface of roller 14 may alternatively comprise rubber, elastomeric, or other materials which simply apply paint deposited upon their surface. In the particular embodiment illustrated, the material or materials providing the exterior surface of roller 14 are affixed to a rigid tubular core which mounts upon bearing member 24 (shown as a cage). Alternatively, the material or materials forming the exterior circumferential surface of roller 14 may be integrally formed with or permanently affixed to a structure which is connected to frame 22. Furthermore, roller 14 may alternatively be configured to be permanently or releasably attached to an end of frame 22.

Trim system 16 is pivotally coupled to roller support 12 for rotation about pivot axis 36 (shown in FIG. 4) which extends perpendicular to roller axis 32 and longitudinal axis 38 of handle 20. In the preferred embodiment illustrated, the pivot axis 36 of trim system 16 lies between axial ends 40 and 42 of handle 20 and preferably intersects handle 20. As a result, the length of arm 44 required for trim system 16 is less than the total length of applicator 10. Nonetheless, trim system 16 pivots sufficiently to swing out of the way from roller 14 when loading roller 14 with paint.

By pivoting trim system 16 and shield 46 about pivot axis 36, shield 46 is pulled away from end 18 of roller 14. Shield 46 may be pivoted into close proximity with end 18 with a minimal risk of shield 46 accidentally brushing against the paint covered surface of roller 14. As a result, manufacturing tolerances for trim system 16 may be increased to reduce manufacturing costs and complexity while enhancing the paint trimming performance of applicator 10.

Trim system 16 generally includes arm 44, shield 46, and grip 48. Arm 44 comprises an elongate member pivotally coupled to roller support 12 and supporting shield 46. Although arm 44 is generally illustrated as an elongate rigid metallic band, arm 44 may be formed from a variety of alternative materials and may have a variety of alternative shapes. Arm 44 pivots about pivot axis 36 between a paint applying position (illustrated in FIGS. 1–6) in which shield 46 is in close proximity with end 18 of roller 14 while extending in a plane substantially perpendicular to roller axis 32, and a paint loading position (illustrated in FIG. 7) in which shield 46 is positioned away from end 18 of roller 14.

In the preferred embodiment, arm 44 is inset or received within a slit or recess 50 formed within handle 20. As a result, handle 20 stabilizes the positioning of arm 44 and enables applicator 10 to be a compact painting tool When in the paint loading position (shown in FIG. 7), arm 44 projects from recess 50 and extends in a direction perpendicular to longitudinal axis 38 and parallel to roller axis 32.

Shield 46 includes a blade portion 54. Blade portion 54 comprises a substantially rigid panel and provides at least one trim edge 58. In the particular embodiment illustrated in FIGS. 1–7, blade portion 54 is formed from a rigid polymeric material, and two opposite thin metallic strips which provide trim edges 58 are secured to the opposite sides of blade portion 54. Trim edge 58 may also comprise plastic and/or be integrally formed with blade portion 54. Trim edges 58 may comprise any material or structure which provides a thin knife-like edge that may be pressed against a trim, molding or other surface adjacent to the surface being painted, thereby preventing (in concert with blade portion 54) the inadvertent application of paint to such adjacent surface.

Figure 7:
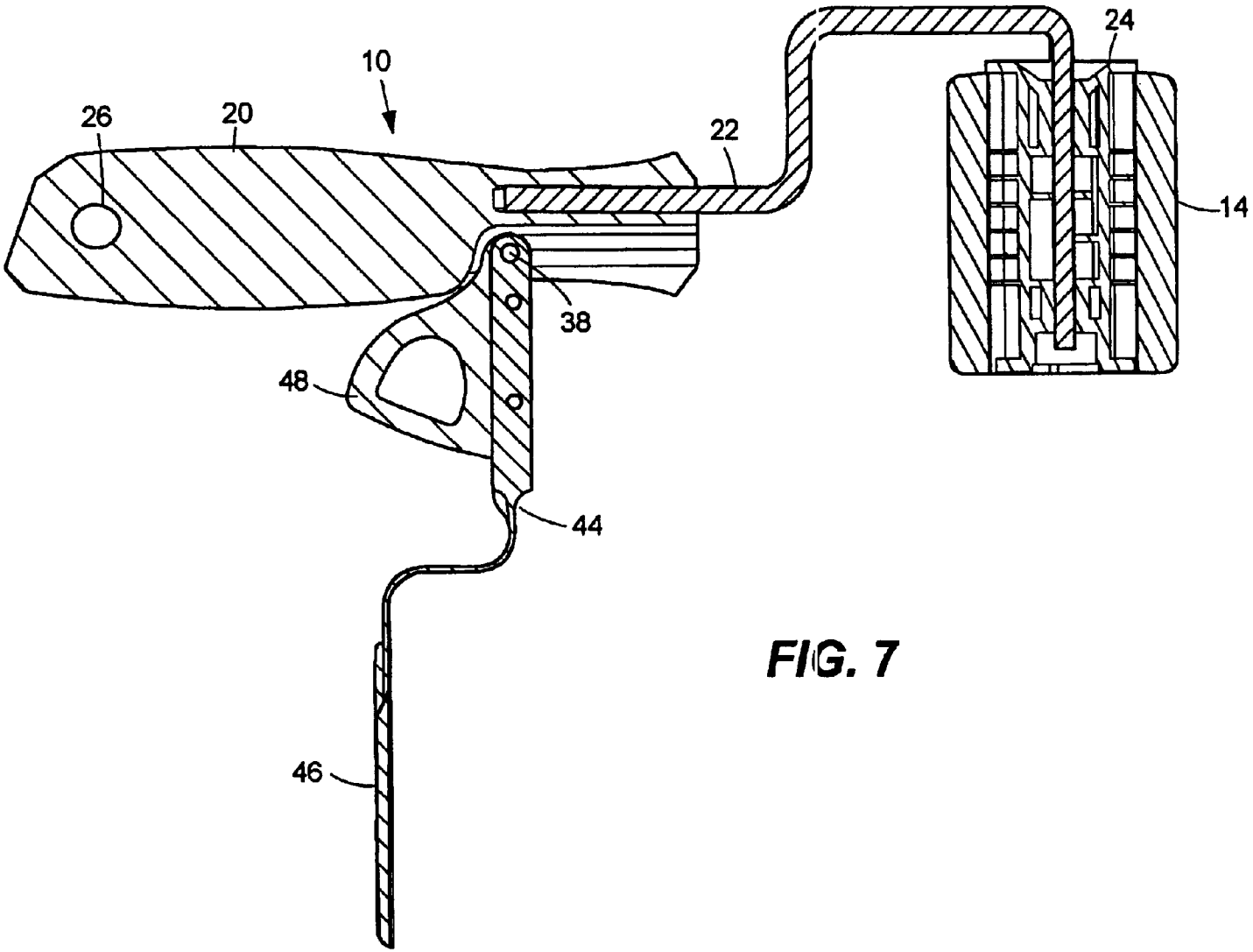
FIG. 7 is a cross sectional view similar to FIG. 6, but depicted in the paint loading position.

Grip 48 comprises a projection or tab coupled to or integrally formed as part of arm 44 and configured to be gripped or grasped by the painter when actuating trim system 16 (i.e., arm 44 and shield 46) between the paint applying position (shown in FIGS. 1–6) and the paint loading position (shown in FIG. 7). In the embodiment illustrated in FIGS. 1–7, grip 48 is partially received within recess 50 when arm 44 is in the paint applying position. However, the remainder of grip 48 projects from recess 50 and is sized to be easily identified and grasped by the painter for actuation of arm 44 to the paint loading position. Grip 48 is typically provided with an opening 66 to facilitate gripping of grip 48. Opening 66 is preferably dimensioned so as to be large enough to receive an averaged sized index finger.

Grip 48 and opening 66 may have various other alternative shapes. Overall, grip 48 intuitively identifies trim system 16 and the pivotal movement of trim system 16. Further, grip 48 facilitates easy gripping and movement of trim system 16. Actuation of trim system 16 from the paint applying position to the paint loading position (or vice versa) does not involve grasping arm 44 or shield 46. Accordingly, the painter's hands do not become covered with paint upon actuation of trim system 16. Because grip 46 is coupled to arm 44 at a location between axial ends 40 and 42 of handle 20, grip 48 is situated well away from roller 14 and shield 46, thereby preventing the painter's hands from becoming covered with paint upon actuating grip 48. Alternatively, grip 48 may be provided with other grip-enhancing structures. For example, grip 48 may omit opening 66 and may alternately include a grooved surface, a dimpled surface, or a surface having a soft, compressible material such as an elastomeric material or a foam or sponge material.

Figure 8:
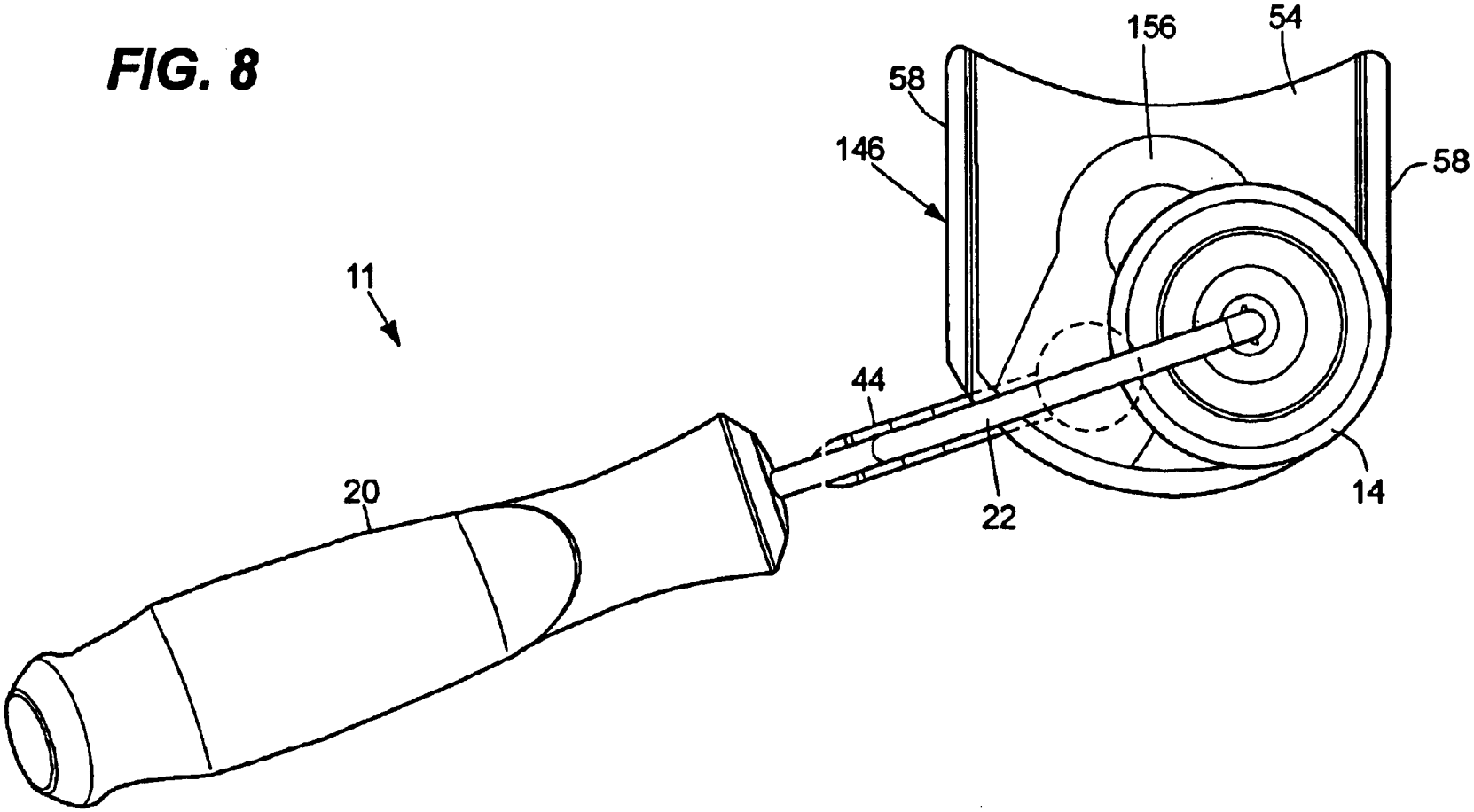
FIG. 8 is a perspective view of an alternative paint applicator in accordance with the disclosure.
Figure 9:
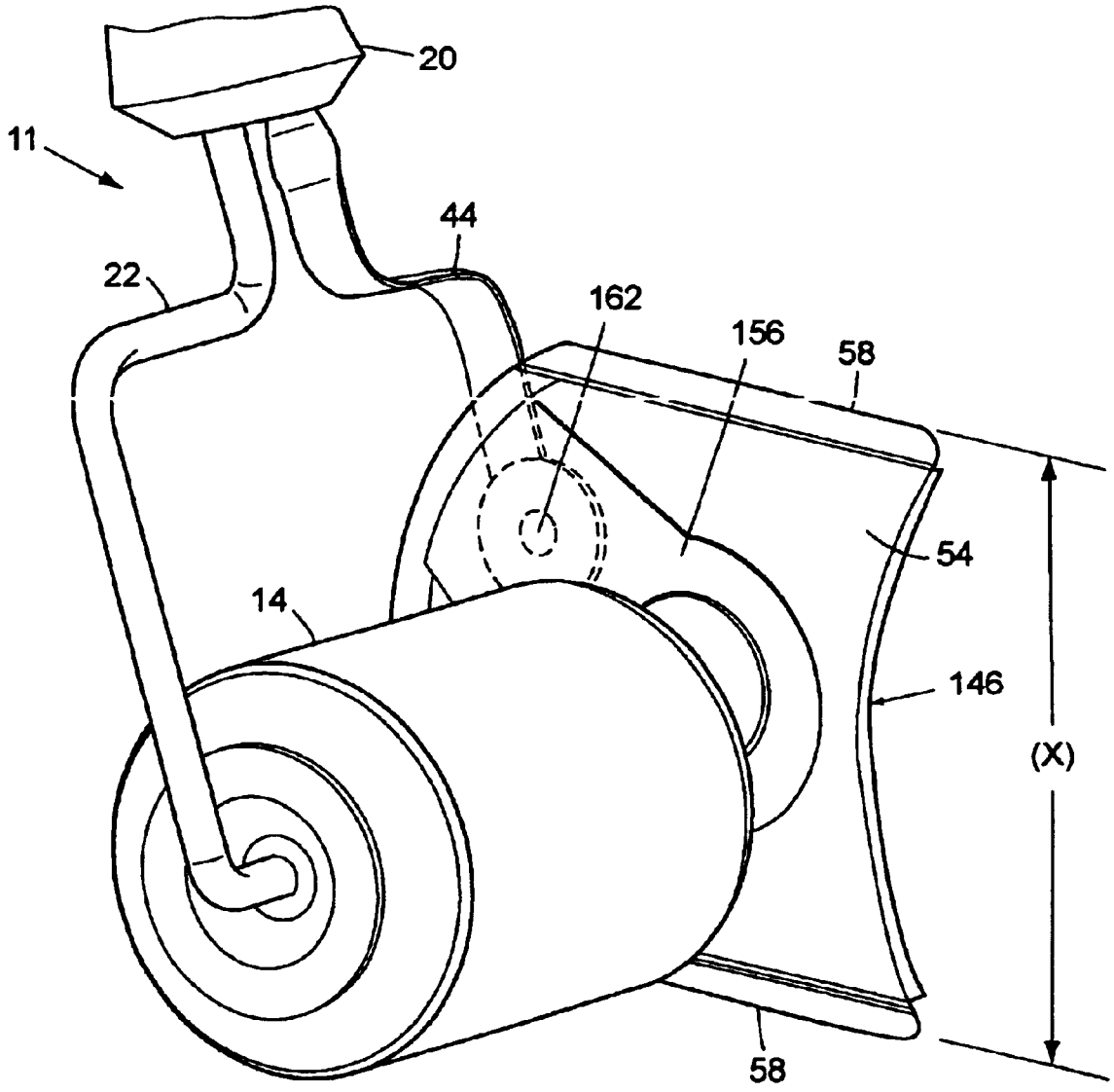
FIG. 9 is an enlarged perspective view of the paint applicator of FIG. 8.
Figure 10:
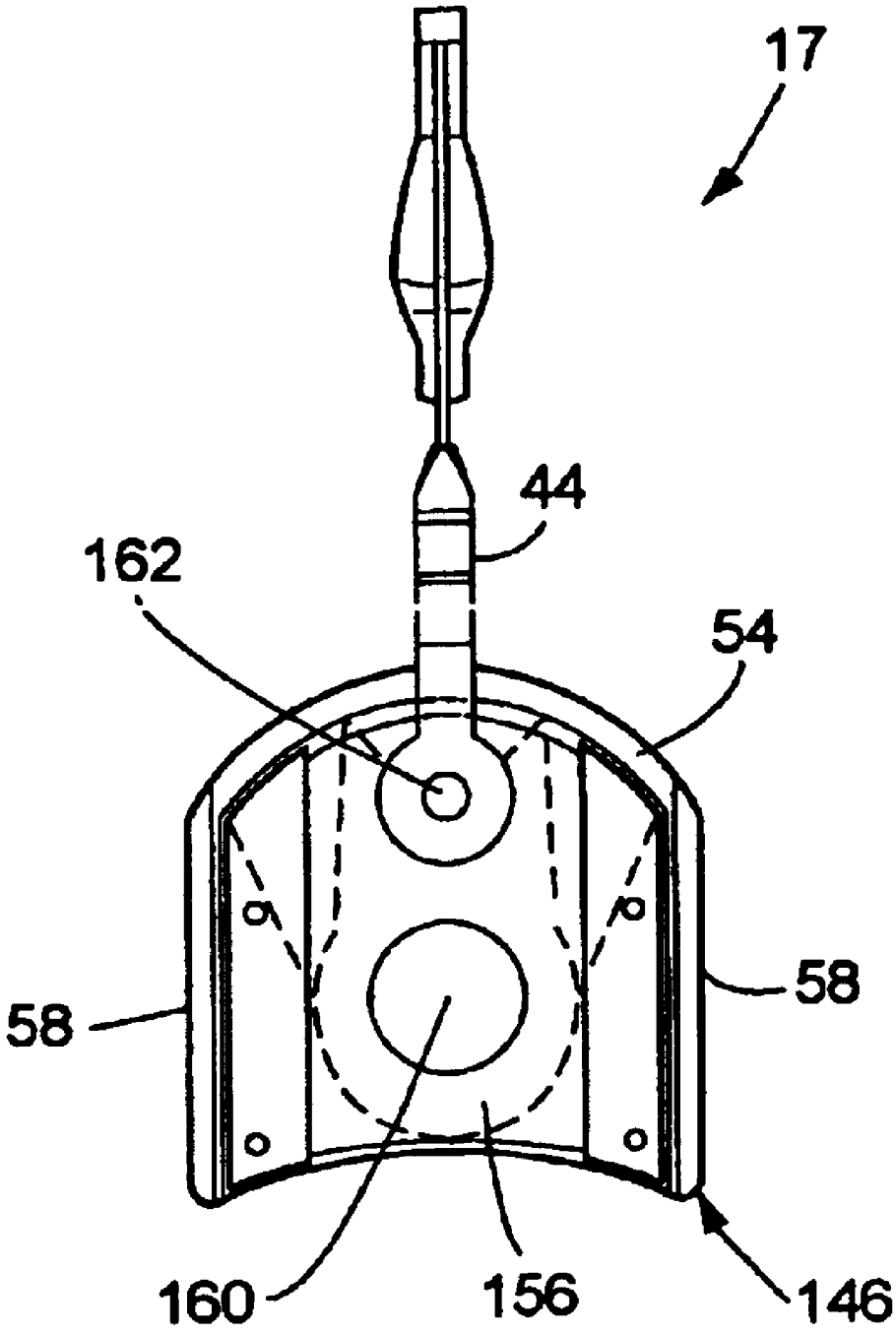
FIG. 10 is a top plan view of a trim system in accordance with the embodiment depicted in FIG. 8.

FIGS. 8–10 illustrate paint applicator 11, an alternative embodiment of paint applicator 10. Paint applicator 11 is similar to paint applicator 10 except that paint applicator 11 includes an alternative trim system 17, which includes shield 146 in lieu of shield 46. For ease of illustration, the components of applicator 11 and trim system 17 which correspond to similar components of applicator 10 and trim system 16, respectively, are numbered similarly. Shield 146, like shield 46, includes blade portion 54 and at least one trim edge 58. Shield 146 further includes an intermediate pivot portion 156.

Pivot portion 156 extends between blade portion 54 and arm 44, and provides a pivot point for blade portion 54 and arm 44. In particular, blade portion 54 is pivotally coupled to pivot portion 156 for rotation about axis 160, and arm 44 is pivotally coupled to pivot portion 156 for rotation about axis 162. The pivot points 160 and 162 for shield 146 enable the positioning of shield 146 to be adjusted relative to roller 14, i.e., roller 14 and handle 20 may be held at varying angles with respect to shield 146 as roller 14 is rolled along the surface being painted.

Trim edges 58 are spaced from one another by a distance X, usually approximately 3.5 inches, in order to accommodate the use of a large diameter roller 14. In this exemplary embodiment, roller 14 typically has a diameter D of at least about one inch and nominally about 1.5 inches. Diameter D may be lesser than about one inch, but this is undesirable because greater application force on handle 20 and roller 14 may then be required, thereby increasing the likelihood of the roller 14 skidding across the surface being painted. As a result, in the exemplary system, a larger diameter roller more easily rolls across the surface being painted despite the force at which roller 14 is pressed against the surface being painted. Accordingly, applicator 11 more quickly and efficiently applies paint to the surface when a larger diameter roller 14 is used.

Figure 11:
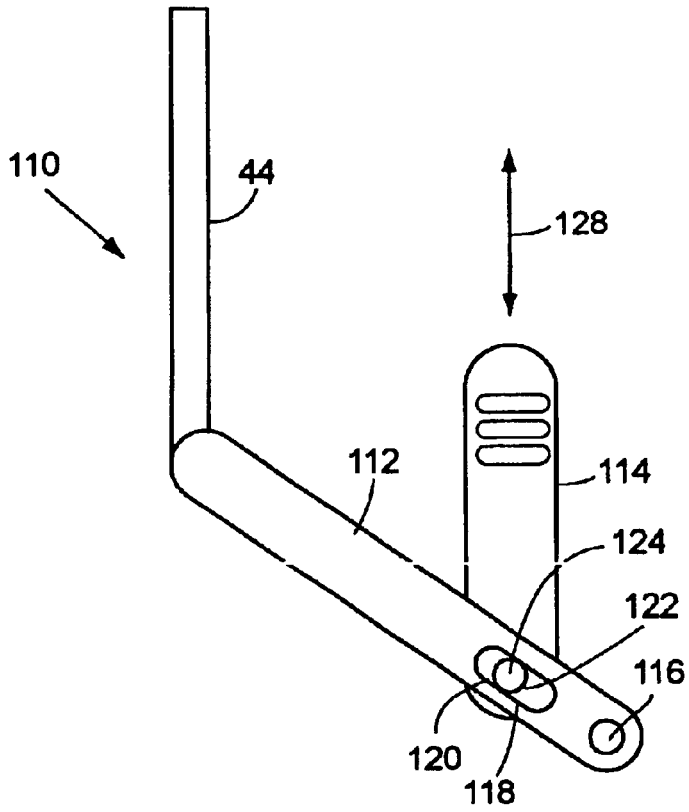
FIG. 11 is a schematic view of an alternative mechanism for pivoting a trim system in accordance with the disclosure.
Figure 12:
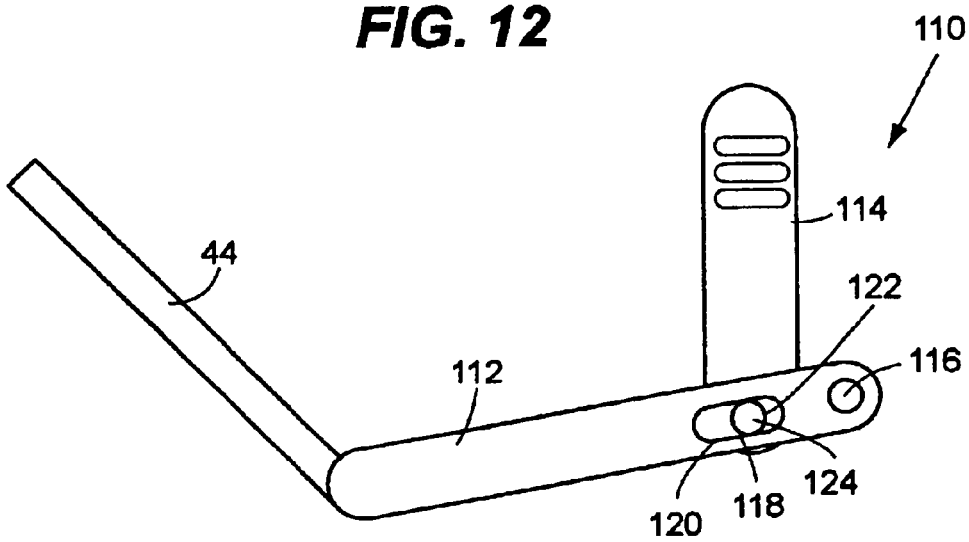
FIG. 12 is a schematic view of the alternative actuation mechanism of FIG. 11, but depicted in a disengaged position.

FIGS. 11 and 12 schematically illustrate an alternative mechanism 110 for pivoting or swinging arm 44 and shield 46 between the paint applying or paint trimming position (shown in FIGS. 1–6) and the paint loading position (shown in FIG. 7) in which shield 46 is swung away from end 18 of roller 14. For ease of illustration, the components of actuation mechanism 110 which correspond to similar components found in applicator 10 are numbered similarly.

Alternative actuation mechanism 110 is activated in lieu of grip 48 to pivot or swing shield 46 between the paint loading position (disengaged position) and the paint applying position (engaged position). In particular, actuation mechanism 110 includes bar 112 and actuator 114. Bar 112 is coupled to arm 44 and extends into an interior cavity of handle 20. Bar 112 is pivotably coupled to handle 20 for rotation or pivotal movement about axis 116. Bar 112 additionally includes a cam follower surface 118 provided by slot 120.

Actuator 114 comprises a button, slide, or similar mechanism slidably coupled to handle 20 to facilitate movement of trim system 16 relative to the remainder of handle 20. Actuator 114 includes a cam surface 122 provided by pin 124. Pin 124 projects at least partially through slot 120 such that cam surface 122 engages cam follower surface 118. As shown by FIGS. 11 and 12, movement of actuator 114 in the directions indicated by arrows 128 pivots bar 112 about axis 116 and correspondingly pivots arm 44 and shield 46 between a paint applying position and a paint loading position.

Figure 13:
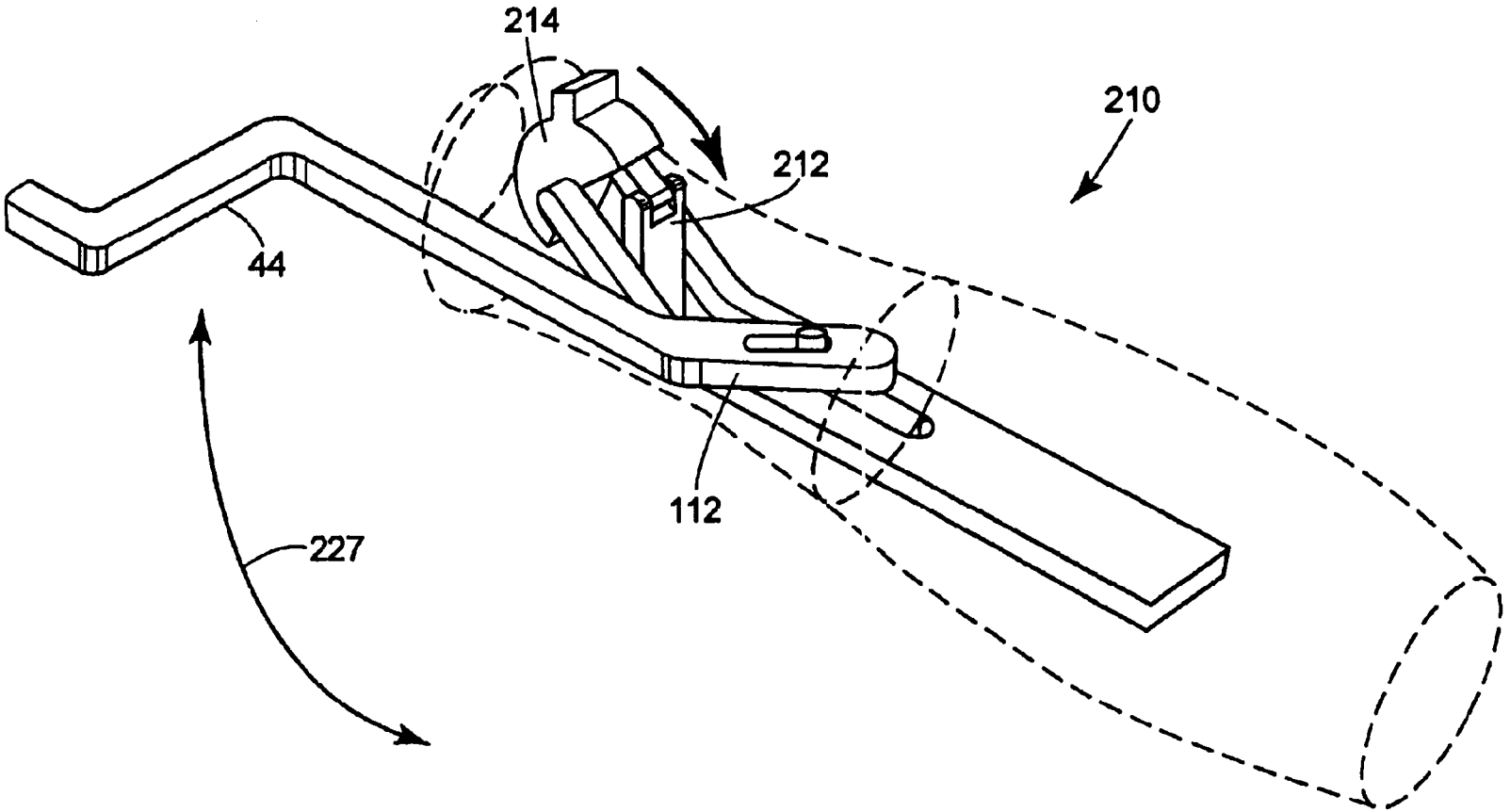
FIG. 13 is a phantom perspective view of an additional alternative trim system actuation mechanism in accordance with the disclosure.
Figure 14:
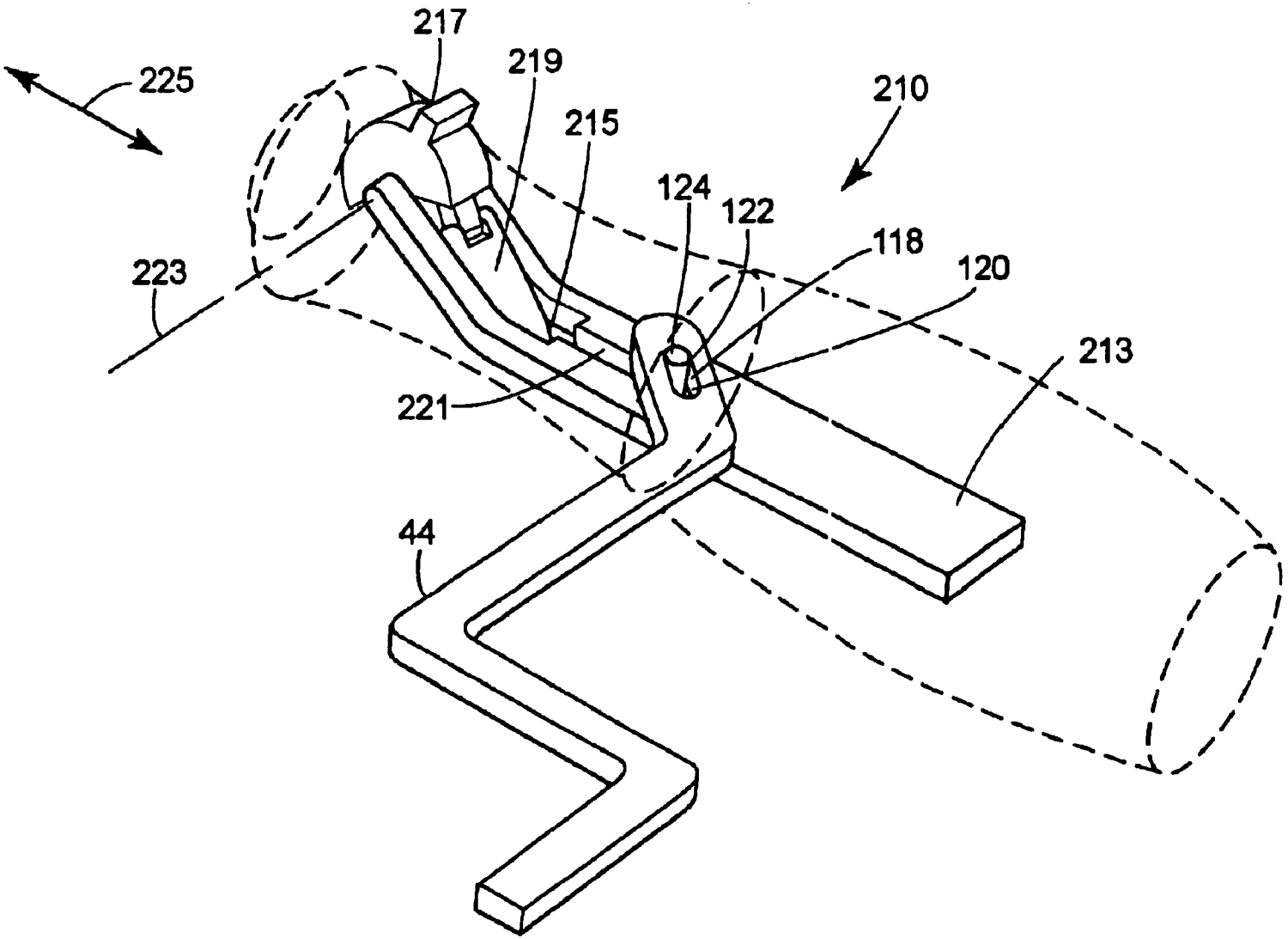
FIG. 14 is a phantom perspective view of the alternative trim system actuation mechanism of FIG. 13, but depicted in a paint loading position.

FIGS. 13 and 14 schematically illustrate trim system actuation mechanism 210, an alternative embodiment of actuation mechanism 110. Actuation mechanism 210 is similar to actuation mechanism 110, except that actuation mechanism 210 includes guide support 213, pin support 215, actuator 217, and link 219 in lieu of actuator 114. For ease of illustration, the components of actuator 210 which correspond to similar components of actuation mechanism 110 are numbered similarly.

Guide support 213 comprises an elongate, rigid structure having an elongate slot 221 through which post 124 projects into slot 120. Support 213 further pivotally supports actuator 217 for rotation about axis 223. Actuator 217 is in turn pivotally coupled to link 219 which is pivotally coupled to pin support 215. Pin support 215 extends below guide support 213. As shown by FIGS. 13 and 14, rotation of actuator 217 about axis 223 slides pin support 215 and pin 124 in the directions indicated by arrows 225. As a result, cam surface 122 engages cam follower surface 118 to swing or pivot arm 44 and shield 46 between the paint applying position and the paint loading position, as indicated by the direction arrows 227.

Figure 15:
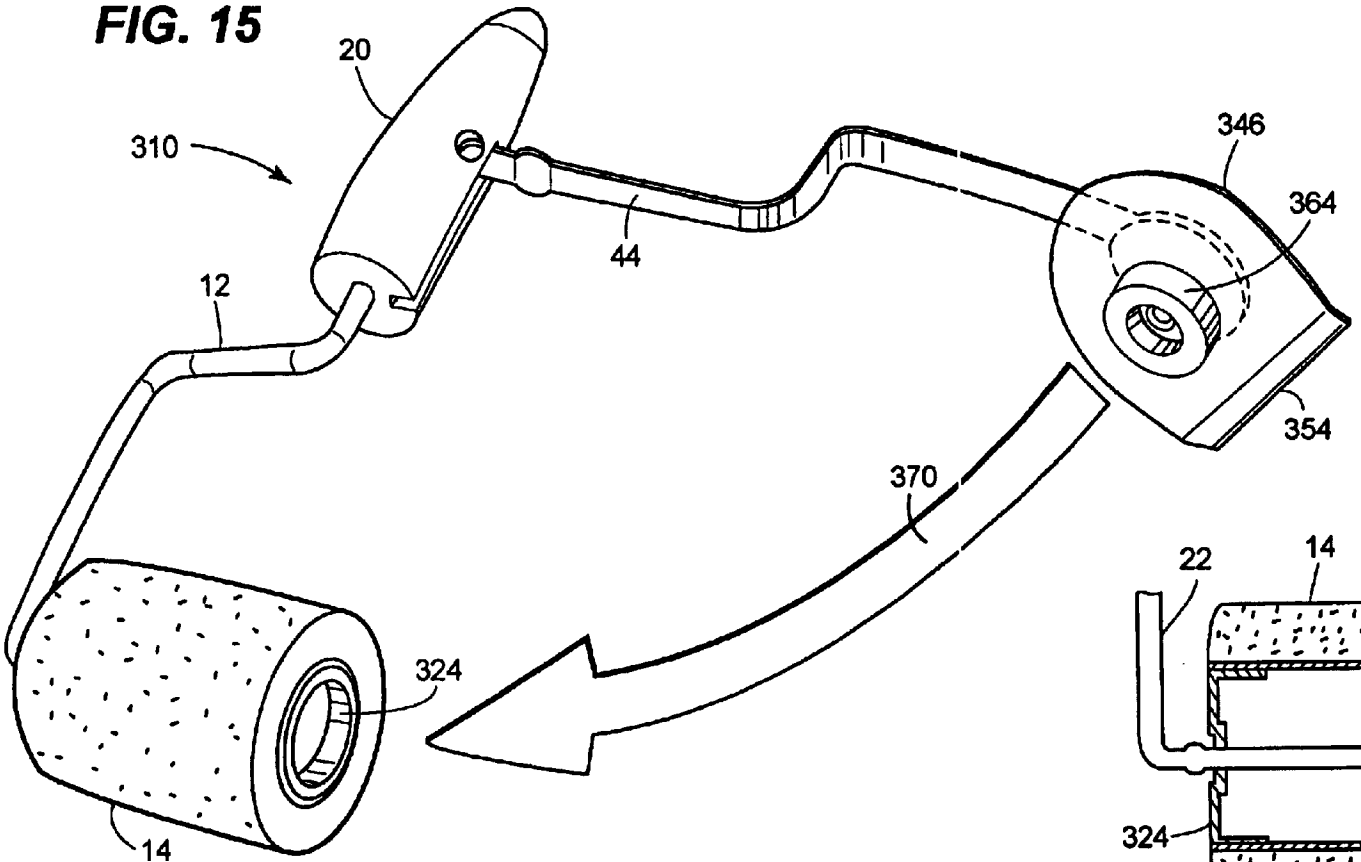
FIG. 15 is a perspective view of an alternative embodiment of a paint applicator in accordance with the disclosure.
Figure 17:
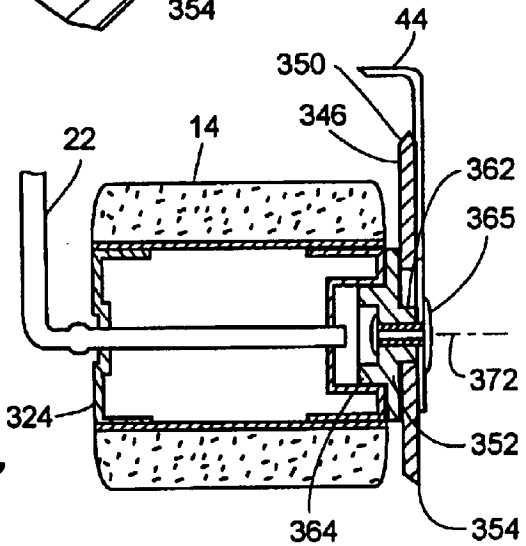
FIG. 17 is a cross sectional view of a paint applicator in accordance with the embodiment shown in FIG. 15.
Figure 16:
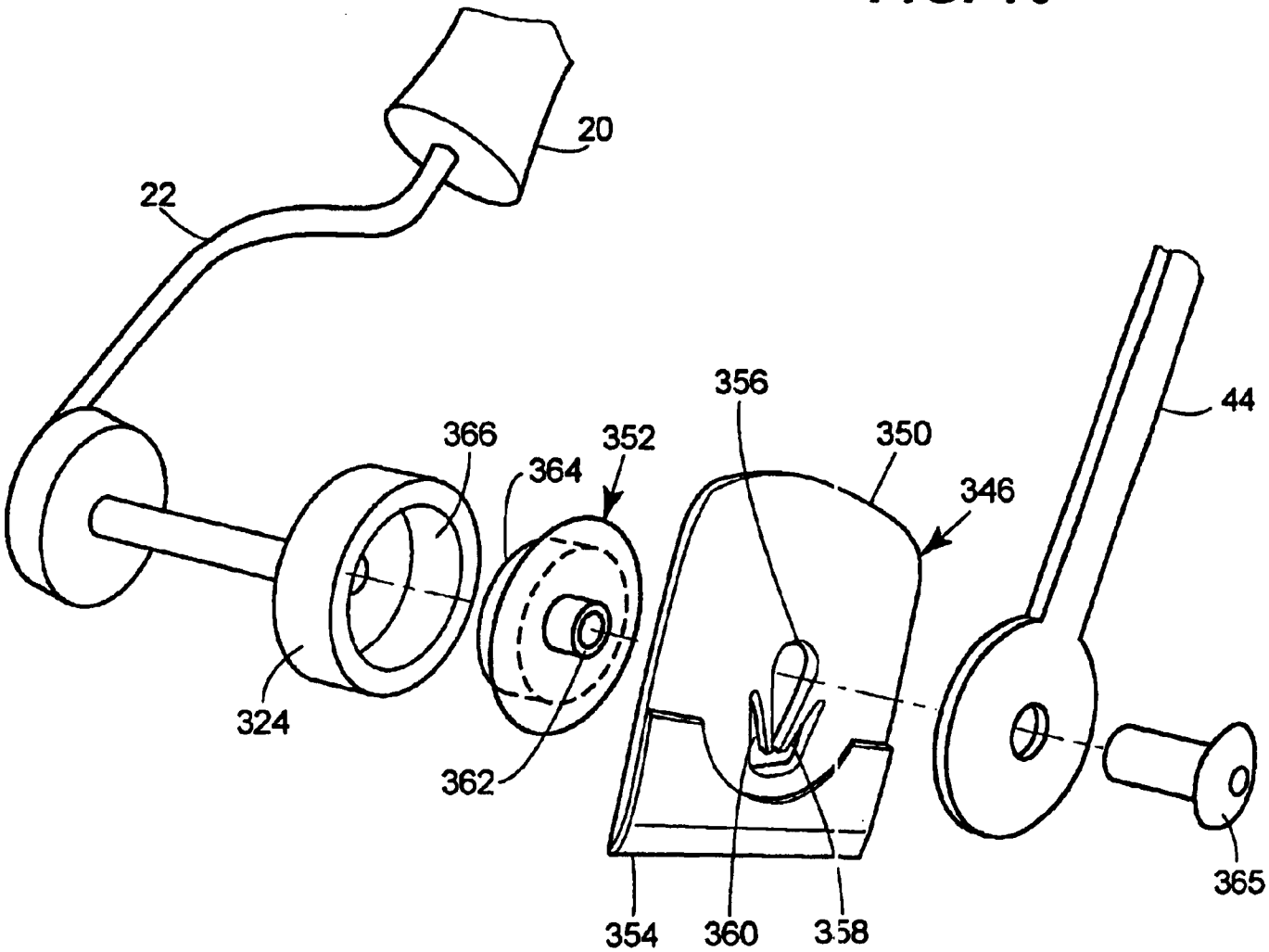
FIG. 16 is an exploded perspective view of the paint applicator shown in FIG. 15.
Figure 18:
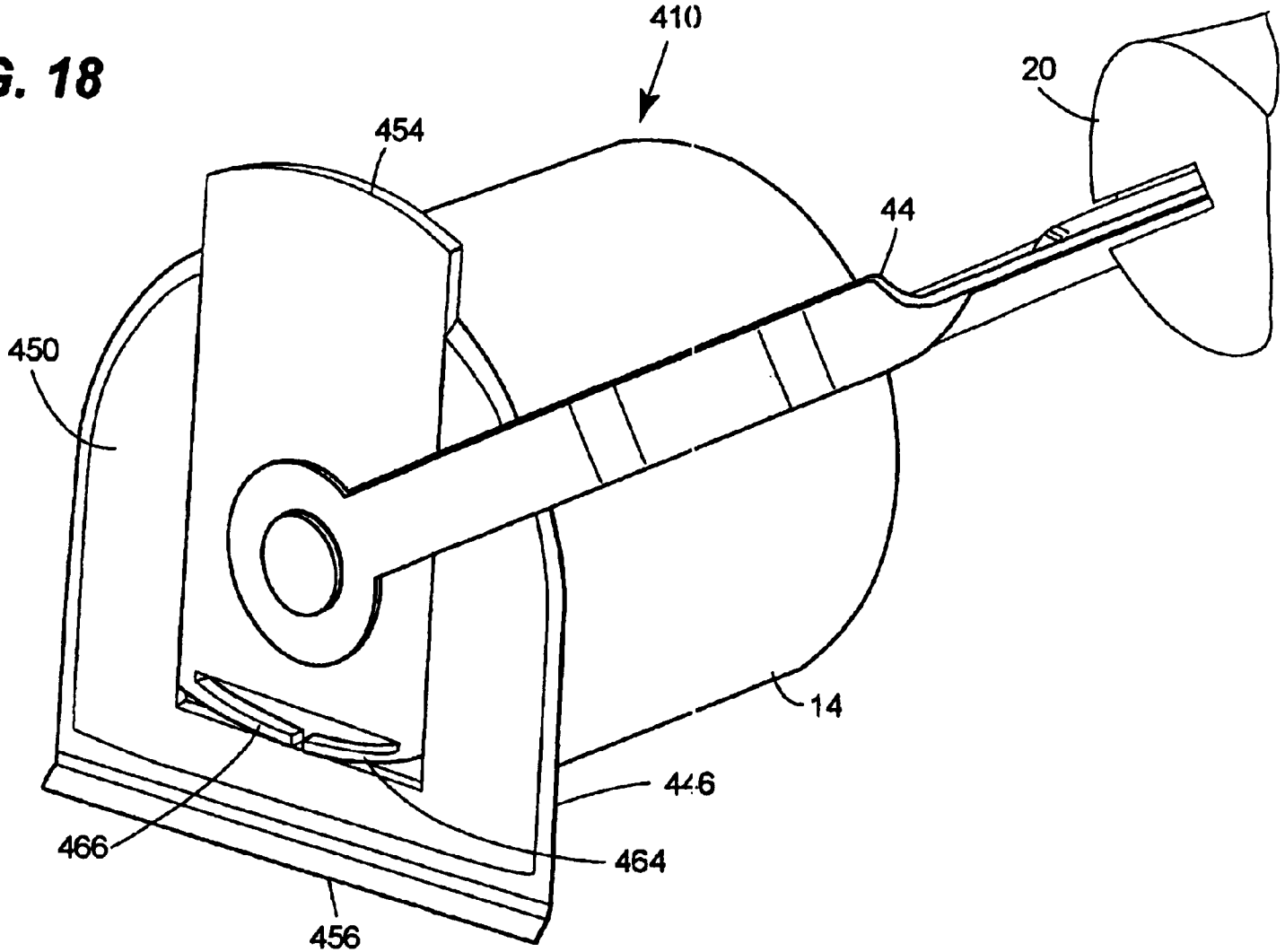
FIG. 18 is a perspective view of an additional alternative embodiment of a paint applicator in accordance with the disclosure.
Figure 19:
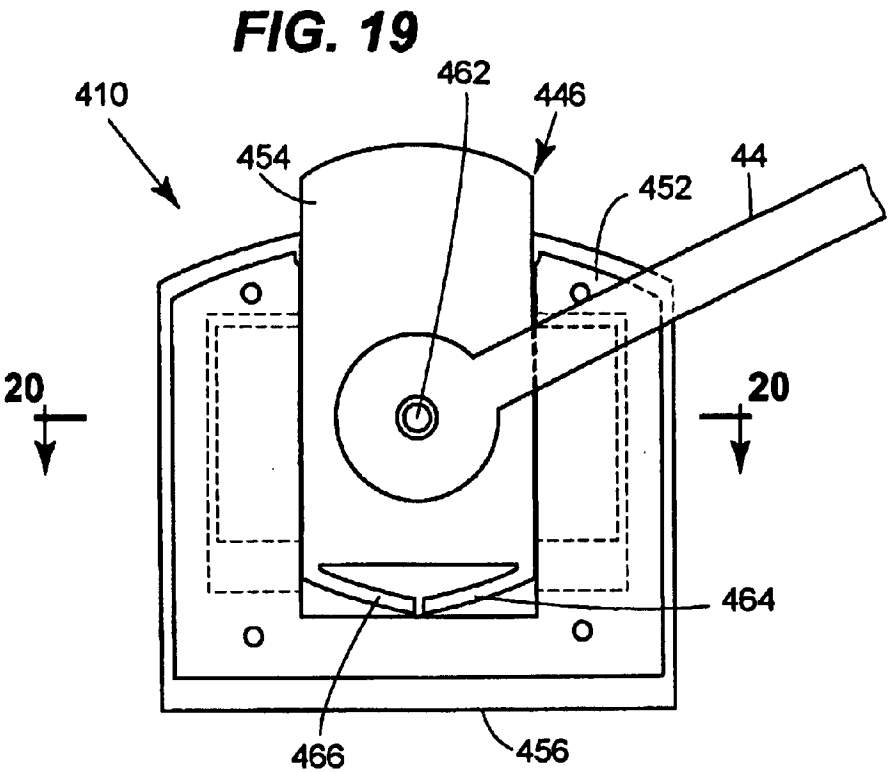
FIG. 19 is a side view of a trim system in accordance with the paint applicator embodiment depicted in FIG. 18.
Figure 20:
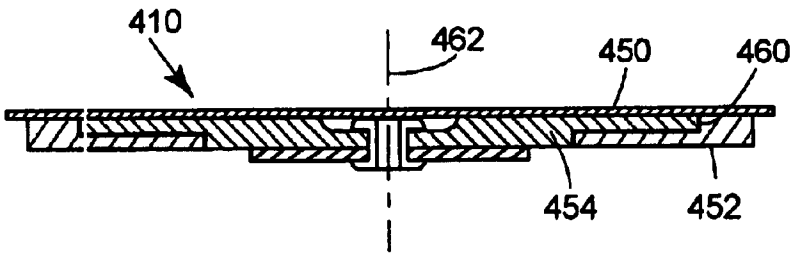
FIG. 20 is a cross sectional view along line 20—20 of the trim system shown in FIG. 19.

FIGS. 15–17 illustrate paint applicator 310, an alternative embodiment of paint applicator 10. Paint applicator 310 is similar to paint applicator 10 except that paint applicator 310 includes shield 346 in lieu of shield 46 and bearing member 324 in lieu of bearing member 24, and omits grip 48. For ease of illustration, the components of applicator 310 which correspond to similar components of applicator 10 are numbered similarly.

As best shown by FIG. 16, shield 346, which is preferably formed from plastic, includes blade 350, bearing 352, at least one trim edge 354, aperture 356, and at least one spring 358, 360. Trim edge 354 comprises a linear defined edge configured to be positioned closely to a surface adjacent to the surface being painted. Trim edge 354 may be integrally formed with blade 350 or may be attached to blade 350 as a separate piece. Trim edge 354 may be formed from plastic or may preferably be provided by a thin metallic plate secured to the remainder of blade portion 350. Aperture 356 extends through blade portion 350 proximate to springs 358, 360. Bearing 352 extends between blade portion 350 and bearing member 324. Bearing 352 includes a first hub 362 which projects through opening 356 and is pivotally coupled to arm 44 by fastener 365. Bearing 352 includes a second hub 364 configured to be at least partially received within an internal axial cavity 366 formed as part of bearing member 324.

As shown by FIG. 15, arm 44 and shield 346 are swung in the direction indicated by arrow 370 to the position shown in FIG. 17. As roller 14 is rolled along the surface being painted, hub 362 of bearing 352 simply rotates within aperture 356 (pivot hole). Applying pressure on handle 20 towards the surface being painted causes roller 14, bearing member 324, bearing 352, and hub 362 to bear against springs 358 and 360 such that trim edge 354 moves relative to the outer circumferential surface of roller 14. Similarly, reducing the amount of force which handle 20 and roller 14 are pressed against the surface being painted results in springs 358 and 360 engaging hub 362 to force trim edge 354 towards the surface being painted.

Applicator 310 provides several advantageous features. First, because shield 346 is resiliently biased in a direction perpendicular to the rotational axis of roller 14, shield 346 automatically repositions itself and maintains trim edge 354 against the surface being painted irregardless of changes in the amount of force with which roller 14 is pressed against the surface being painted. Thus, paint may be applied closer to the trim or other adjacent surface without becoming accidentally deposited upon the trim. Second, because shield 346 is not fixedly coupled to an axial end of roller 14, shield 346 may be swung out of position by movement of arm 44 to enable roller 14 to be quickly and easily loaded with paint. Thirdly, because arm 44 is pivotally coupled to shield 346 about a single axis 372, the positioning of shield 346 may be adjusted with respect to handle 20 and arm 44.

FIGS. 18–21 generally illustrate paint applicator 410, an alternative embodiment of paint applicator 310. Like applicator 310, paint applicator 410 has a shield resiliently biased in a direction perpendicular to the rotational axis 32 of roller 14 when the trim system is in the paint applying position. Applicator 410 is similar to applicator 310, except that applicator 410 includes shield 446 in lieu of shield 346. For ease of illustration, the components of applicator 410 that correspond to similar components of applicator 310 are numbered similarly.

Figure 21:
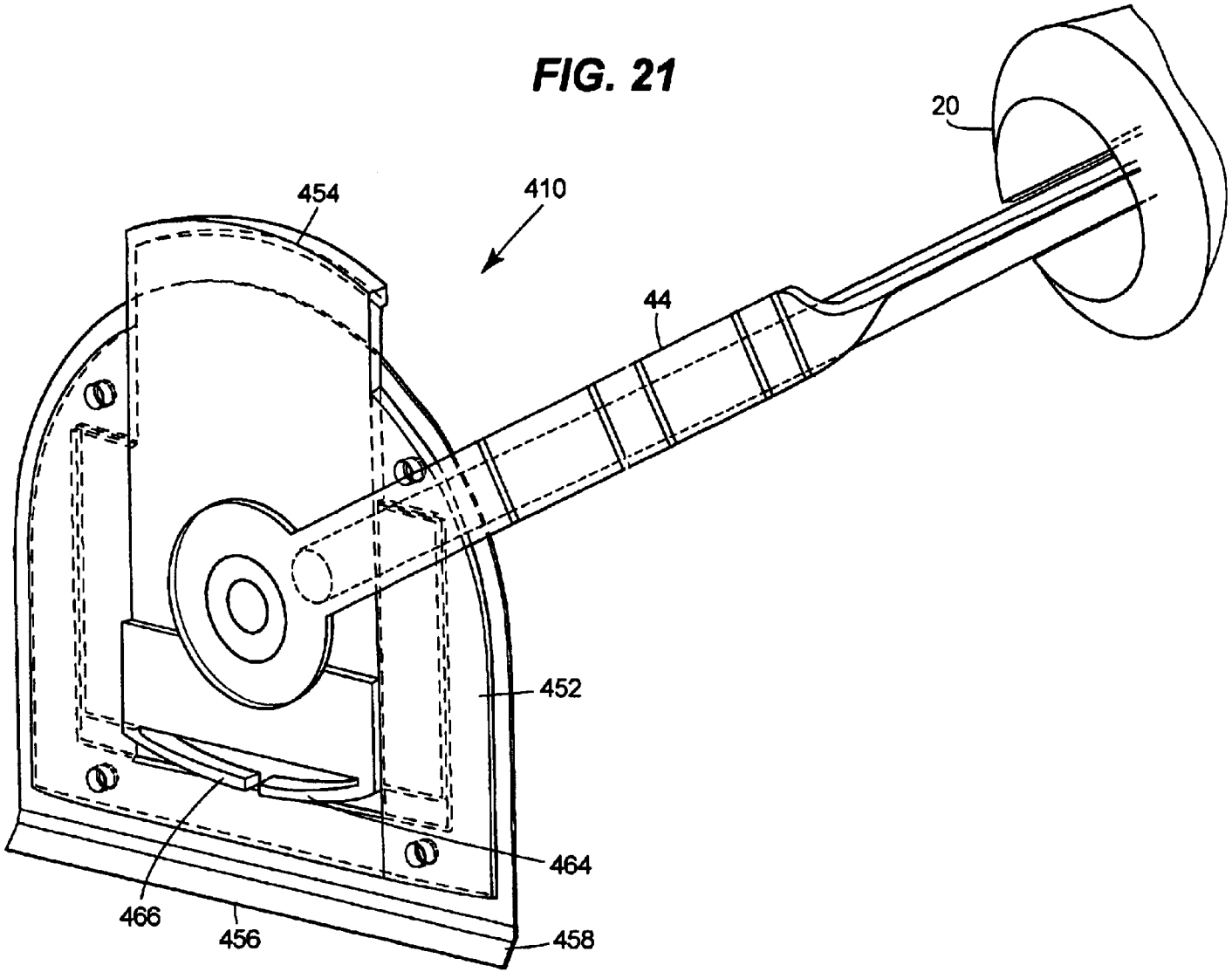
FIG. 21 is a perspective view of a trim system in accordance with the embodiment depicted in FIG. 19.
Figure 22:
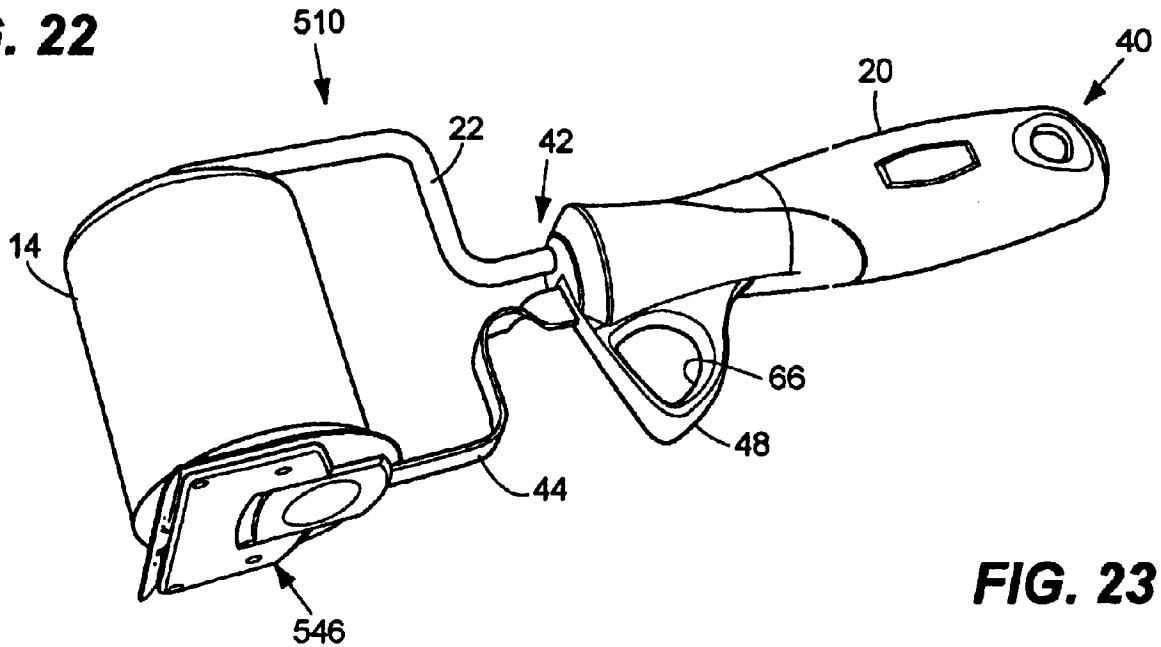
FIG. 22 is a perspective view of an additional embodiment of a paint applicator in accordance with the disclosure.
Figure 23:
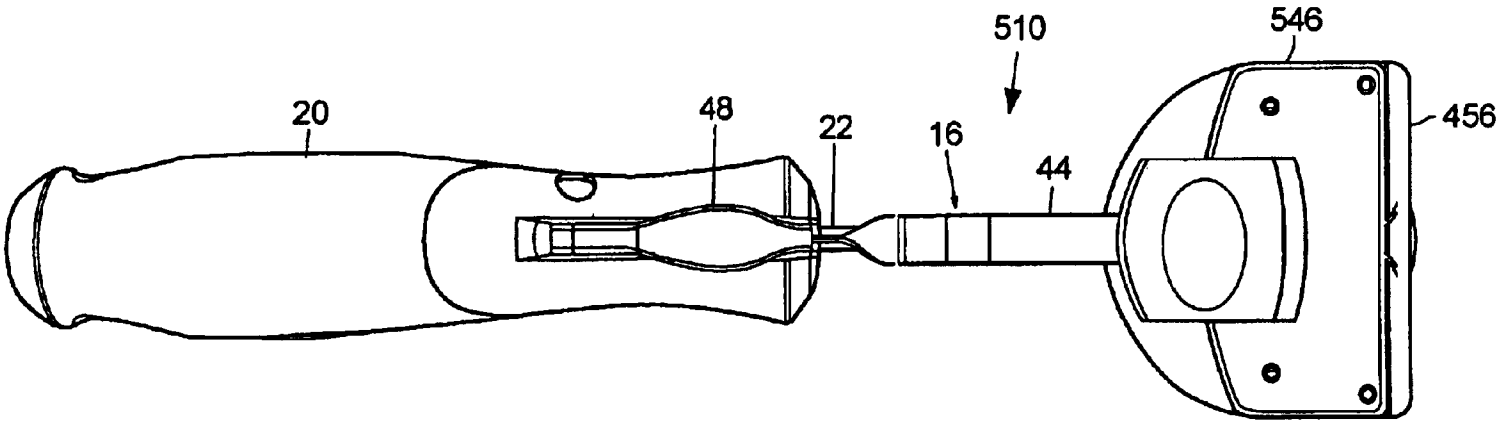
FIG. 23 is a night side view of the paint applicator shown in FIG. 22.
Figure 24:
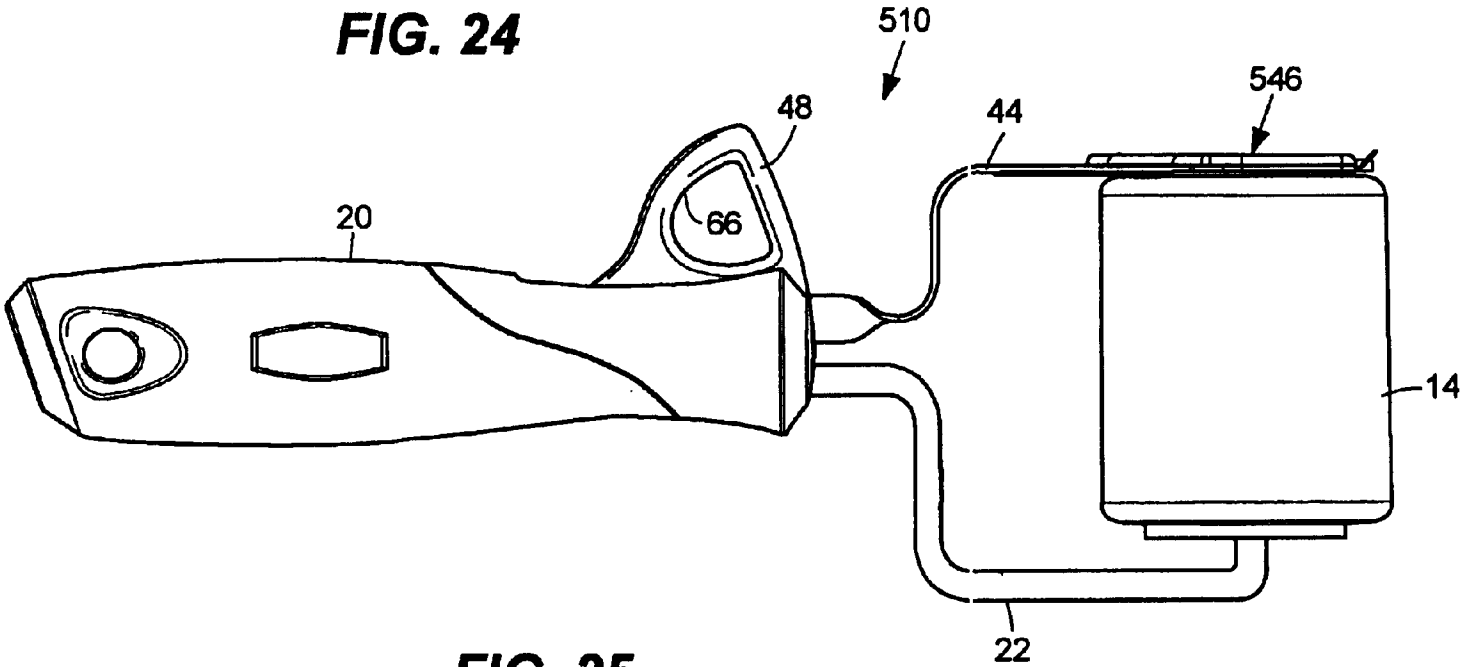
FIG. 24 is a top view of the paint applicator shown in FIG. 23.
Figure 25:
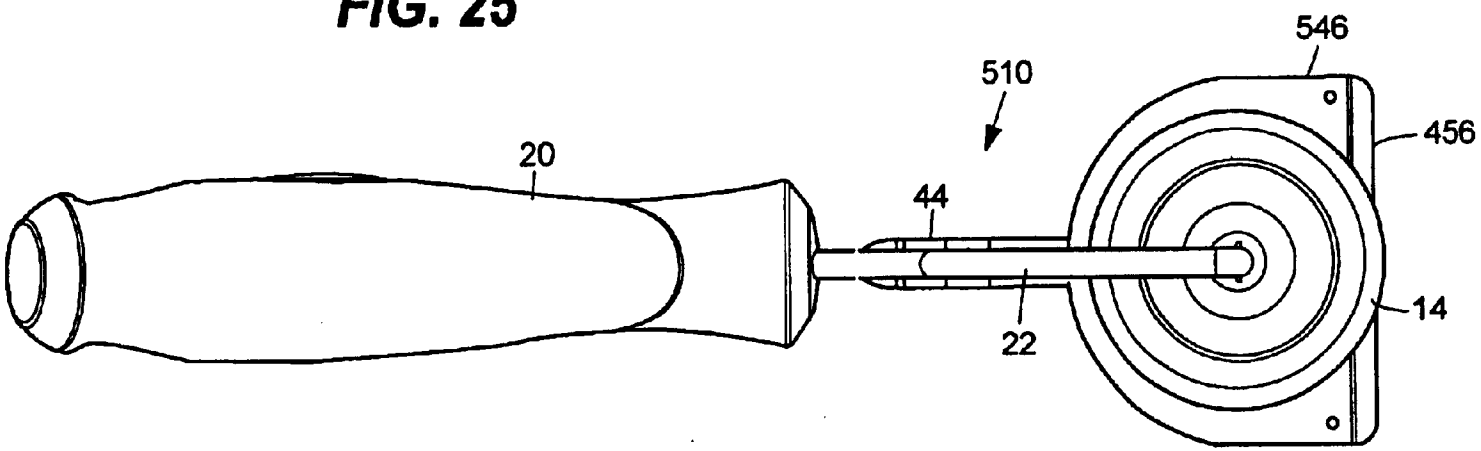
FIG. 25 is a left side view of the paint applicator shown in FIG. 23.
Figure 26:
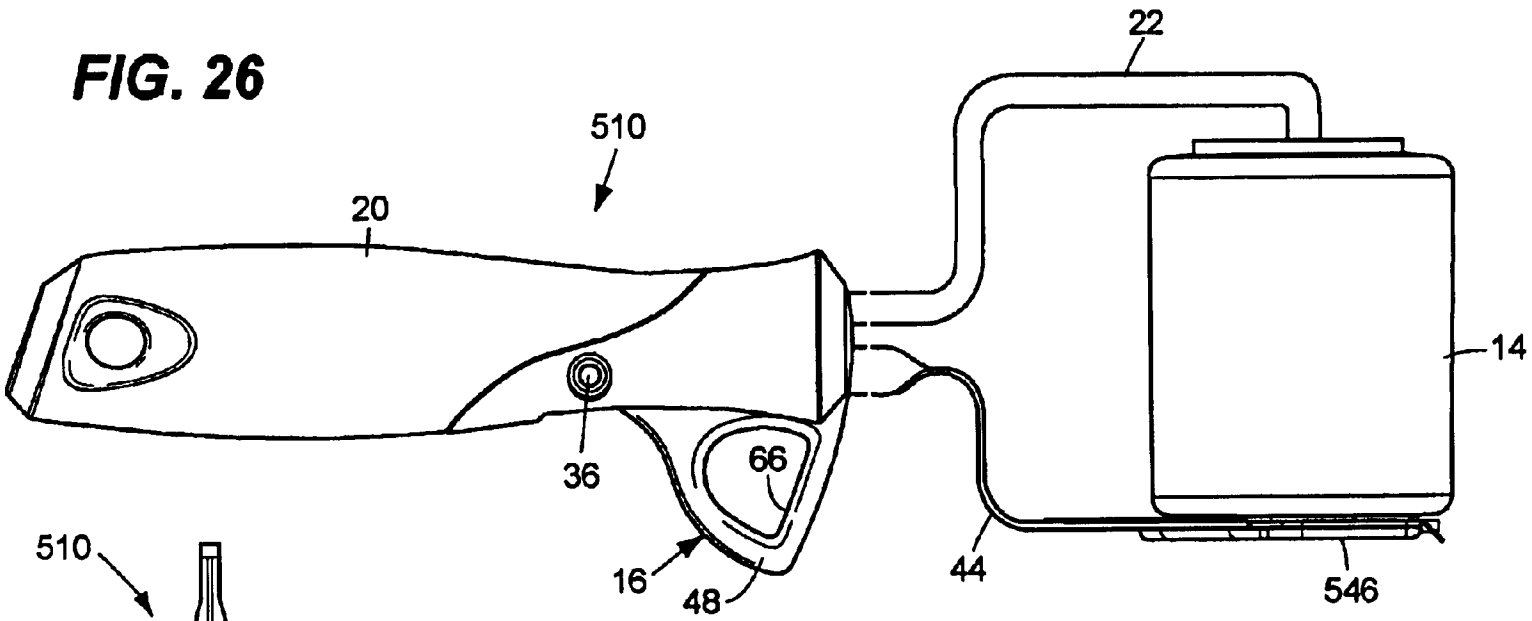
FIG. 26 is a bottom view of the paint applicator shown in FIG. 23.
Figure 27:
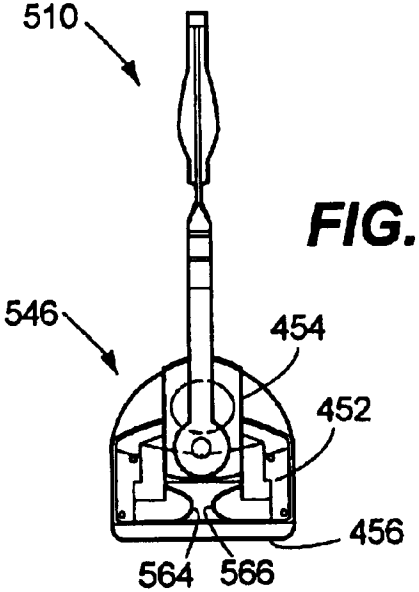
FIG. 27 is a top plan view of a trim system in accordance with the paint applicator embodiment depicted in FIG. 23.

Shield 446 generally includes face plate or blade 450, guide 452, and slide 454. Blade 450 comprises a rigid and thin member providing a lower trim edge 456 which bears against the surface being painted and along the trim or other adjacent surface adjacent the surface being painted. As shown by FIG. 21, trim edge 456 preferably extends along a lower end of an outwardly tapered member 458. The outwardly tapered portion 458 of blade 450 reduces frictional engagement between shield 446 and the adjacent trim surface. In the particular embodiment illustrated, blade 450 is preferably formed from metal. Alternatively, blade 450 may be formed from other rigid materials such as plastic and the like.

Guide 452 comprises a rigid member fixed to blade 450. Guide 452 cooperates with blade 450 to form an interior cavity 460 in which slide 454 is received. Guide 452 and blade 450 cooperate to further slidably capture slide 454 therebetween. Although guide 452 is illustrated as comprising a separate component fastened to blade 450 by rivets, guide 54 may alternatively be fastened to blade 450 by adhesives, mechanical interlocks, or other fastening methods. Moreover, guide 452 may alternatively be integrally formed as part of a single unitary body with blade 450. In yet alternative embodiments, other conventionally known or future developed mechanisms may be employed to slidably or movably support slide 454 relative to blade 450.

Slide 454 comprises a member pivotally coupled to arm 44 for rotation about axis 462 and slidably received within cavity 460. Slide 454 is preferably configured to slide relative to blade 450 in a direction perpendicular to axis 462. Slide 454 additionally includes springs 464, 466. Springs 464, 466 are integrally formed as part of a single unitary body with slide 454 and extend within cavity 460 into engagement with a lower surface of guide 452. Springs 464, 466 resiliently bias slide 454 away from trim edge 456. Said in another way, springs 464, 466 resiliently bias trim edge 456 towards the surface being painted in a direction perpendicular to axis 462. Because springs 464, 466 are preferably integrally formed as part of a single unitary body with slide 454, shield 446, and applicator 410 require fewer parts, lowering manufacturing costs and complexity. Alternatively, shield 446 may include separate springs formed from polymeric materials or metals which are mounted or coupled between slide 454 and guide 452. Examples include leaf springs, coil springs, tension springs, and the like.

Although shield 446 is illustrated as including a single trim edge 456 which is resiliently biased in one direction towards the paint applying surface by at least one spring 464, 466, shield 446 may alternatively include a second substantially linear trim edge opposite trim edge 456. In such an alternative embodiment, slide 454 would additionally include separate or integrally formed springs configured bear against guide 452 to resiliently bias the second opposite trim edge away from the first trim edge 456. Such an alternative embodiment would enable the paint applicator to be used along opposing trim surfaces without requiring the applicator to be flipped. The same bi-directional modifications may also be applied to paint applicator 310.

FIGS. 22–27 illustrate paint applicator 510, an alternative embodiment of applicators 10, 11, 310, and 410. Applicator 510 is similar to applicator 10 except that applicator 510 includes shield 546 in lieu of shield 46. For ease of discussion, the components of applicator 510 which find corresponding components in applicator 10 are numbered similarly. Shield 546 is similar to shield 446 of applicator 410 except that shield 546 includes springs 564, 566 in lieu of springs 464, 466. Additionally, for ease of discussion, the components of shield 546 which are substantially similar to corresponding components of shield 446 are numbered similarly.

Springs 564, 566 comprise elongate, resiliently flexible bands of elastomeric material integrally formed as a single unitary body with slide 454. Like springs 464, 466, springs 564, 566 resiliently bias trim edge 456 towards the surface being painted to accommodate different amounts of pressure being applied to applicator 510 towards the surface being painted. Like applicator 410, applicator 510 may alternatively include springs which are independent of slide 454 and made from various other materials such as metal and the like. Moreover, springs 564, 566 may alternatively be integrally formed as part of a single unitary body with guide 452.

Although paint applicator 510 is illustrated as including grip 48, paint applicator 510 may alternatively include the actuation mechanisms 110 or 210.

Overall, applicators 10, 11, 310, 410 and 510 provide a paint trimming or edging roller that is ergonomic, intuitive to use, less fatiguing, and less prone to skidding, sturdy, and simple to manufacture. The enlarged diameter of roller 14 facilitated by the increased size of the shield 46, 446, or 546 enables paint to be applied to the surface by the applicators with less force and less time. Grip 48 or actuation mechanisms 110, 210 enable the shield to be moved between the paint applying position and the paint loading position while the painter's hands remain distant from the paint covered roller 14. Shields 346, 446, and 546 automatically adapt to varying degrees of force applied to the applicator by the painter to ensure consistent results. Shields 446 and 546 further reduce the frictional resistance between the roller and the shield for improved painting performance by providing at least one trim edge providing an outwardly tapered surface.

Although the present disclosure has been described with reference to preferred embodiments, workers skilled in the art will recognize that changes may be made in form and detail without departing from the spirit and scope of the disclosure. For example, although different preferred embodiments may have been described as including one or more features providing one or more benefits, it is contemplated that the described features may be interchanged with one another or alternatively be combined with one another in the described preferred embodiments or in other alternative embodiments. Because the technology of the present disclosure is relatively complex, not all changes in the technology are foreseeable.

Although the foregoing text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A paint applicator comprising:

a roller support;

a roller coupled to the roller support and rotatably supported about a roller axis; and a trim system including an arm movably coupled to the roller support, a shield coupled to the arm, and an actuation mechanism coupled to the arm, wherein the trim system is movable between a first position in which the shield is proximate the roller and a second position in which the shield is distant the roller by actuating the actuation mechanism, the shield is coupled to the arm by a pivot such that the shield is rotatable about the pivot portion, and the shield is resiliently biased in a direction perpendicular to the roller axis.

2. The paint applicator of claim 1 wherein the roller support includes a handle and a frame.

3. The paint applicator of claim 2 including a pivot member rotatably coupled to the arm and the handle.

4. The paint applicator of claim 3 wherein the shield is rotatable at least about 135 degrees about the pivot member.

5. The paint applicator of claim 2 wherein the actuation mechanism comprises a bar coupled to the arm and an actuator including a cam surface coupled to the handle.

6. The paint applicator of claim 2, wherein the handle includes a recess for receiving a portion of the arm and a portion of the actuation mechanism.

7. The paint applicator of claim 1 wherein the pivot portion is pivotally coupled to the shield for rotation of the shield about a first rotation axis and to the arm for rotation of the shield about a second rotation axis.

8. The paint applicator of claim 1 further comprising a spring coupled to the arm.

9. The paint applicator of claim 1 wherein the actuation mechanism is a grip including an opening sized to receive an averaged sized index finger.

10. A paint applicator comprising:

a roller support including a frame and a handle having a first axial end, a second axial end and a recess, the recess beginning at the first axial end and ending at a location between the first axial end and the second axial end;

a roller mounted on a bearing member, coupled to the frame, and rotatably supported about a first axis defined by the bearing member; and a trim system including an arm pivotally coupled to a second axis located between the first axial end and the second axial end, a shield coupled to the arm, and an actuation mechanism coupled to the arm, wherein the trim system is movable between a first position in which the shield is proximate the roller and the arm is partially received within the recess and a second position in which the shield is distant the roller and the arm projects from the recess in direction parallel to the first axis by actuating the actuation mechanism.

11. The paint applicator of claim 10 wherein the shield provides a trim edge.

12. The paint applicator of claim 11 wherein the trim edge provides an outwardly tapered surface.

13. The paint applicator of claim 10 wherein the shield is resiliently biased in a direction perpendicular to the first axis.

14. The paint applicator of claim 13 further comprising a spring coupled to the arm.

15. The paint applicator of claim 10 wherein the shield is coupled to the arm by a pivot portion and is rotatable about the pivot portion.

16. The paint applicator of claim 15 wherein the pivot portion is pivotally coupled to the shield for rotation of the shield about a first rotation axis and to the arm for rotation of the shield about a second rotation axis.

17. The paint applicator of claim 10 including a pivot member rotatably coupled to the arm and the handle.

18. The paint applicator of claim 17 wherein the shield is rotatable at least about 135 degrees about the pivot member.

19. The paint applicator of claim 10 wherein the actuation mechanism is a grip including an opening sized to receive an averaged sized index finger.

20. The paint applicator of claim 10 wherein the actuation mechanism comprises a bar coupled to the arm and an actuator including a cam surface coupled to the handle.

* * * * *